US006999035B2

(12) United States Patent
Matsumoto et al.

(10) Patent No.: US 6,999,035 B2
(45) Date of Patent: Feb. 14, 2006

(54) ANTENNA DEVICE AND METHOD OF MANUFACTURING SAME

(75) Inventors: Kenji Matsumoto, Chino (JP); Masaki Hoshina, Suwa (JP)

(73) Assignee: Seiko Epson Corporation, (JP)

( * ) Notice: Subject to any disclaimer, the term of this patent is extended or adjusted under 35 U.S.C. 154(b) by 0 days.

(21) Appl. No.: 10/814,655

(22) Filed: Mar. 31, 2004

(65) Prior Publication Data

US 2004/0239576 A1 Dec. 2, 2004

(30) Foreign Application Priority Data

Apr. 1, 2003 (JP) ..... 2003-098261

(51) Int. Cl.
*H01Q 19/10* (2006.01)

(52) U.S. Cl. ..... 343/755; 343/753; 343/840

(58) Field of Classification Search ..... 343/840, 343/912, 914, 753, 755, 754
See application file for complete search history.

(56) References Cited

U.S. PATENT DOCUMENTS 5,512,913 A * 4/1996 Staney ..... 343/781 P
5,606,334 A * 2/1997 Amarillas et al. ..... 343/840

FOREIGN PATENT DOCUMENTS

| | | |
|---|---|---|
| JP | 04-100302 | 4/1992 |
| JP | 05-57912 | 7/1993 |
| JP | 06-38321 | 5/1994 |
| JP | 09-008543 | 1/1997 |
| JP | 2000-216623 | 8/2000 |
| JP | 2001-255660 | 9/2001 |
| JP | 2002-074765 | 3/2002 |

OTHER PUBLICATIONS

Communication from Japanese Patent Office regarding counterpart application.

* cited by examiner

*Primary Examiner*—Hoang V. Nguyen
(74) *Attorney, Agent, or Firm*—Harness, Dickey & Pierce, P.L.C.

(57) ABSTRACT

An antenna device and a method of manufacturing the same are provided. The antenna device can receive a plurality of radio waves, with a small number of parts and at low cost. The antenna device includes a micro lens array and a receiver facing a reflecting surface of the micro lens array. The reflecting surface of the micro lens array is provided with a plurality of different lenses selectively reflecting radio waves with particular frequency ranges to the receiver from among the radio waves transmitted toward the micro lens array.

2 Claims, 7 Drawing Sheets

ANTENNA DEVICE AND METHOD OF MANUFACTURING SAME

RELATED APPLICATIONS

This application claims priority to Japanese Patent Application No. 2003-098261 filed Apr. 1, 2003 which is hereby expressly incorporated by reference herein in its entirety.

BACKGROUND

1. Technical Field of the Invention

The present invention relates to an antenna device and a method of manufacturing the same. More specifically, the present invention relates to an antenna device suitable for a reflective antenna receiving wideband frequencies and a method of manufacturing the same.

2. Description of the Related Art

As examples of methods of receiving a plurality of radio waves with different frequency bands transmitted from broadcasting satellites and communication satellites by using a single antenna device, the two following methods are disclosed.

A first method is a method in which a plurality of receivers are provided for one reflector (see Japanese Unexamined Utility Model Registration Application Publication No. 5-57912). In this method, a parabolic antenna is provided with a plurality of receivers for one parabolic reflector, because radio waves that are not parallel to the central axis of a parabolic reflector converge on different points from the focal point of the parabolic reflector. This makes it possible to receive broadcasting radio waves and communication radio waves whose angles are different from each other with a single parabolic antenna.

A second method is a method in which a plurality of parabolic antennas are disposed on the external surface of a spherical structure to form an antenna device. Each parabolic antenna includes a parabolic reflector and a receiver. Each parabolic antenna receives a particular radio wave (see Japanese Unexamined Utility Model Registration Application Publication No. 6-38321). In this method, substantially all of the spherical structure can receive radio waves. Therefore, there is almost no need to consider directional characteristics. This makes it possible and easy to receive a plurality of radio waves whose frequency bands are different from each other from a plurality of communication satellites.

According to the above known methods of receiving radio waves, a plurality of receivers are provided for one parabolic reflector to form a parabolic antenna, or an antenna device is formed by using a plurality of parabolic antennas, in order to receive a plurality of radio waves whose frequency bands are different from each other. Therefore, the methods have problems in which the number of parts composing the antenna device is large and the manufacturing cost is expensive.

An object of the present invention is to provide an antenna device that can receive a plurality of radio waves, with a small number of parts and at low cost, and to provide a method of manufacturing the same.

SUMMARY

To attain this object, an antenna device according to the present invention includes a reflector and a receiver facing one side of the reflector. The side of the reflector is provided with a plurality of types of lenses selectively reflecting radio waves with particular frequency ranges to the receiver from among the radio waves transmitted toward the reflector, the frequency ranges of the radio waves reflected by the plurality of types of lenses being different from each other. In the present invention, the particular frequency range includes the particular frequency and other frequencies near the particular frequency.

Unlike conventional antenna devices, an antenna device according to the present invention has a plurality of types of lenses corresponding to radio waves with particular frequency ranges on one side of a single reflector. Therefore, it is possible to sensitively adjust the reflection direction of radio waves and to minimize the number of receivers. Consequently, it is possible to decrease the number of parts composing an antenna device that can receive a plurality of radio waves and to lower the cost of manufacturing the antenna device.

A first method of manufacturing an antenna device according to the present invention is a method of forming an antenna device including a reflector and a receiver facing one side of the reflector. The method includes the steps of: forming a mask pattern with a particular shape on one side of a predetermined substrate; dry-etching the mask pattern and the substrate so that the side of the substrate has the particular shape of the mask pattern; and forming a reflecting film on the side having the particular shape of the substrate. The particular shape includes a plurality of types of lenses selectively reflecting radio waves with particular frequency ranges to the receiver from among the radio waves transmitted toward the reflector, the frequency ranges of the radio waves reflected by the plurality of types of lenses being different from each other.

A second method of manufacturing an antenna device according to the present invention is a method of forming an antenna device including a reflector and a receiver facing one side of the reflector. The method includes the steps of: molding a substrate whose one side has a particular shape with an injection molding machine; and forming a reflecting film on the side having the particular shape of the substrate. The particular shape includes a plurality of types of lenses selectively reflecting radio waves with particular frequency ranges to the receiver from among the radio waves transmitted toward the reflector, the frequency ranges of the radio waves reflected by the plurality of types of lenses being different from each other.

Unlike conventional methods, the first and second methods of manufacturing an antenna device according to the present invention make it possible to sensitively adjust the reflection direction of radio waves and to minimize the number of receivers. Consequently, it is possible to manufacture an antenna device that can receive a plurality of radio waves, with a small number of parts and at low cost.

DETAILED DESCRIPTION

An antenna device and a method of manufacturing the same according to the present invention will now be described with reference to the drawings.

First Embodiment

Figure 1:
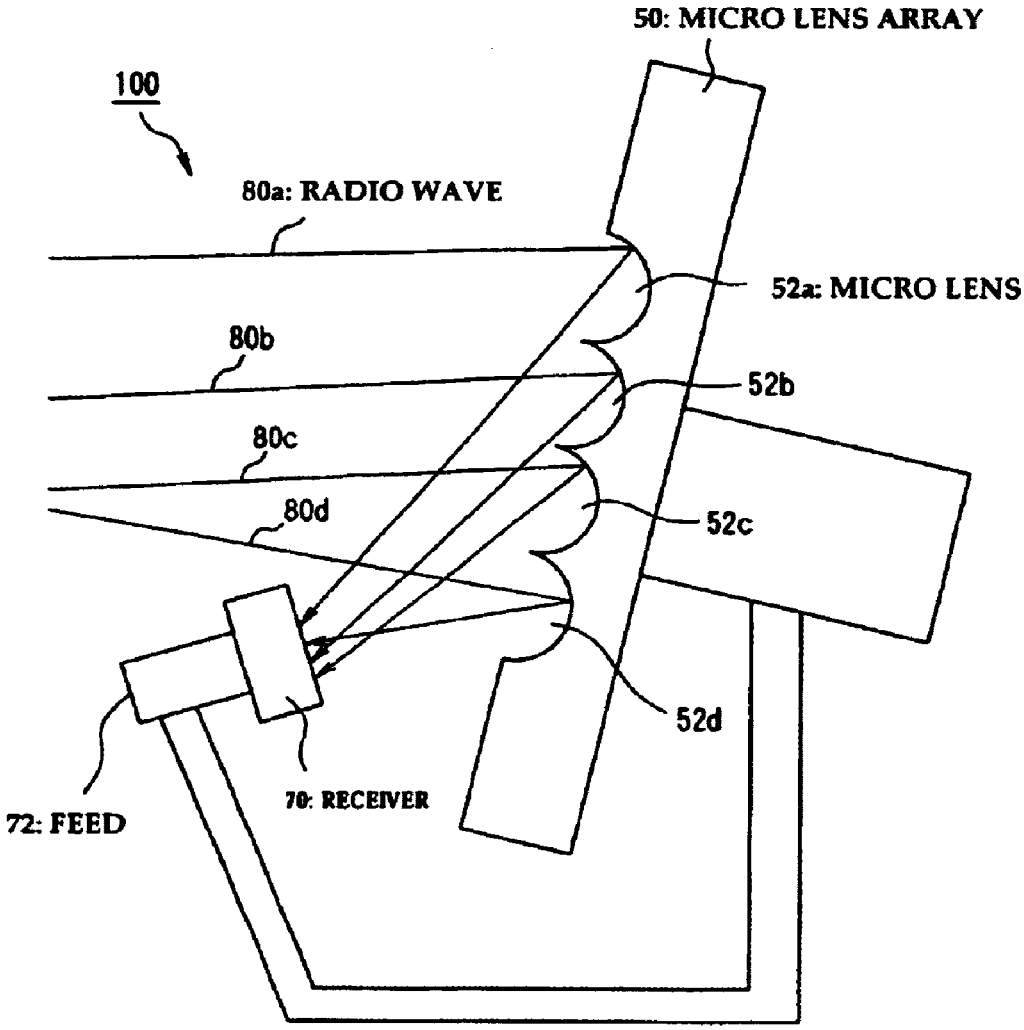
FIG. 1 is a schematic diagram showing an exemplary structure of a reflective antenna device 100.

FIG. 1 is a schematic diagram showing an exemplary structure of a reflective antenna device 100 according to a first embodiment of the present invention. The antenna device 100 receives a plurality of radio waves transmitted from broadcasting satellites and communication satellites toward the ground. The plurality of radio waves 80*a* to 80*d* have different frequencies.

In FIG. 1, the radio waves 80*a* to 80*d* are transmitted from separate satellites. Generally, frequencies are different among these satellites.

Since broadcasting satellites and communication satellites are geostationary satellites, they are usually at different angles with respect to the ground. Therefore, incident angles of the radio waves 80*a* to 80*d* with respect to the reflective antenna device 100 are different from each other. The antenna device 100 shown in FIG. 1 is composed mainly of a reflective micro lens array 50 and a receiver 70 having a feed 72 at a predetermined distance from the micro lens array 50.

As shown in FIG. 1, the micro lens array 50 has a surface to reflect the radio waves 80*a* to 80*d* having different frequencies and to direct or focus them on the feed 72 of the receiver 72. The surface of the micro lens array 50 reflecting radio waves (hereinafter referred to as "reflecting surface") is provided with, four example, four types of micro lenses 52*a* to 52*d* corresponding to the radio waves 80*a* to 80*d*.

The diameters, depths, shapes (e.g., cross-sectional profile), and the like of the micro lenses 52*a* to 52*d* are determined in accordance with the radio waves 80*a* to 80*d* to be reflected. The micro lenses 52*a* to 52*d* focus the radio waves 80*a* to 80*d* on the feed of the receiver 70. Although the term "focus" is used herein, one skilled in the art will appreciate that the feed 72 need not be absolutely positioned at the focal point of the re-directed radio waves. Rather, some margin of error, or tolerance, may be built into the system.

That is to say, the micro lens 52*a* reflects the radio wave 80*a* transmitted from a satellite such as a communication satellite and focuses the radio wave 80*a* on the feed 72. In addition, the micro lens 52*b* focuses the radio wave 80*b* on the feed 72, the radio wave 80*b* being transmitted at a different angle from the radio wave 80*a*. Similarly, the micro lenses 52*c* and 52*d* focus the radio waves 80*c* and 80*d* respectively on the feed 72, the radio waves 80*c* and 80*d* being transmitted at different angles from the radio waves 80*a* and 80*b*.

Figure 2:
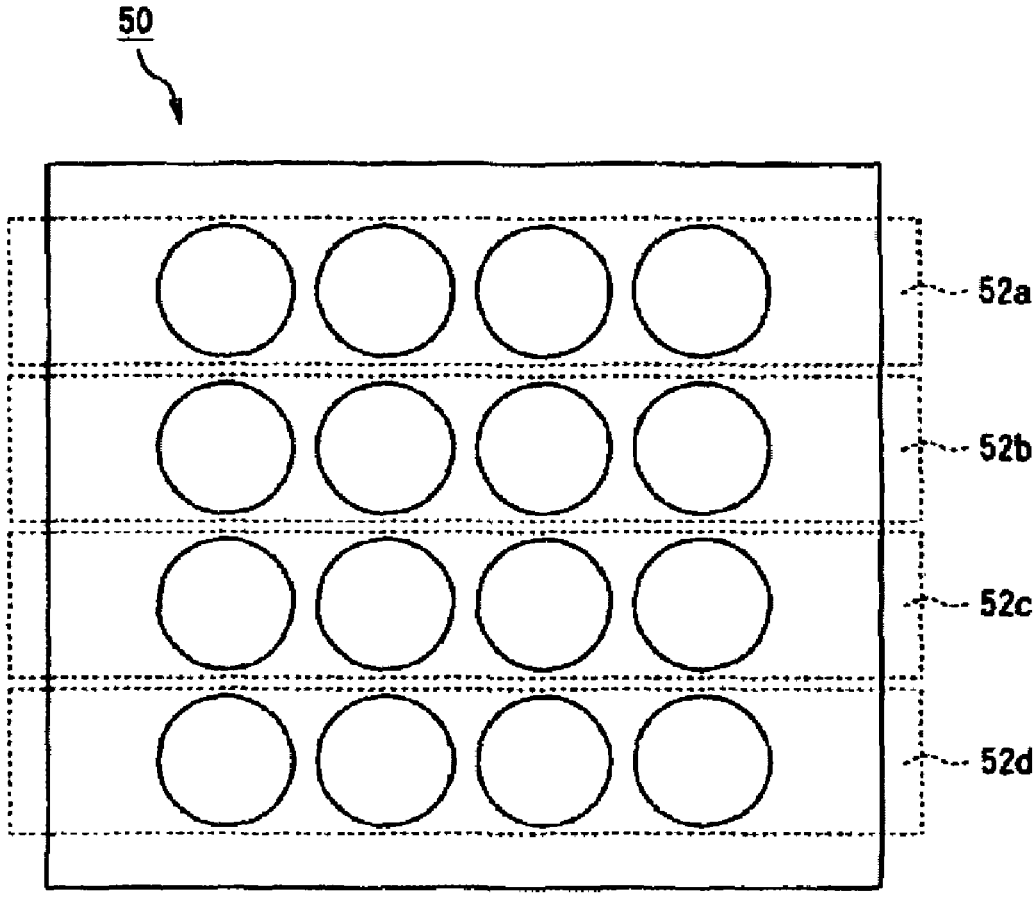
FIG. 2 is a plan view showing an exemplary structure of the micro lens array 50.

FIG. 2 is a plan view showing an exemplary structure of the micro lens array 50. As shown in FIG. 2, four types of micro lenses 52*a* to 52*d* are provided on the reflecting surface of the micro lens array 50 at predetermined spacing. For each type, a plurality of micro lenses are provided. Increasing the number of the micro lenses for each type 52*a* to 52*d* makes it possible to increase the area of the surface reflecting the radio waves 80*a* to 80*d*, thereby making it possible to increase the sensitivity of the antenna device 100, that is to say, the ability to receive the radio waves 80*a* to 80*d*. These types of micro lenses 52*a* to 52*d* have diameters of about 0.12 to 10 $\mu$m and depths of about 0.12 to 10 $\mu$m.

Figure 3A:
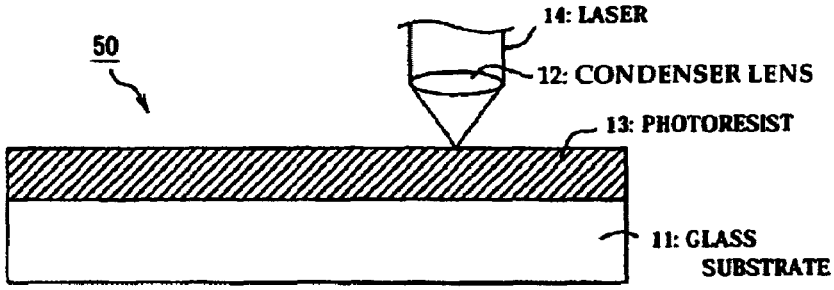
FIGS. 3A–D show a method of manufacturing the micro lens array 50 according to a first embodiment.

A method of manufacturing the micro lens array 50 will now be described with reference to FIGS. 3(A) to 3(D). As shown in FIG. 3(A), a substrate. 11 formed of silica glass (hereinafter referred to as "glass substrate") is first prepared. A face (reflecting surface) of the glass substrate 11 is planarized. The glass substrate 11 has a radius of about 100 mm.

Figure 3B:
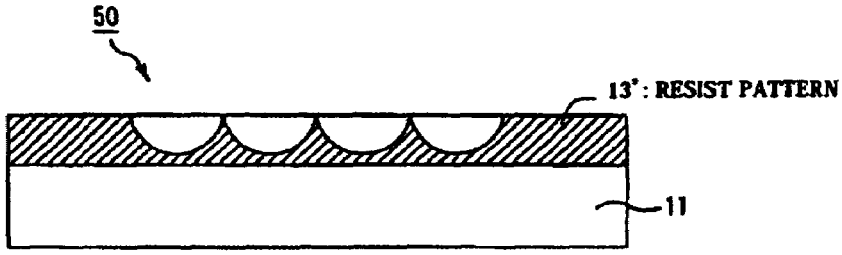

Next, a layer of positive photoresist 13 is applied on the glass substrate 11. The thickness of the layer of the photoresist 13 is about 10 $\mu$m. A laser 14 such as a krypton fluoride excimer laser (248 nm) or an argon fluoride excimer laser (193 nm) is condensed on the photoresist 13 by a condenser lens 12. The laser 14 scans and exposes the photoresist 13. Development of the exposed photoresist 13 reveals a resist pattern 13' corresponding to the pattern shape (concavities) of the micro lenses 52*a* to 52*d* as shown in FIG. 3(B).

Figure 4A:
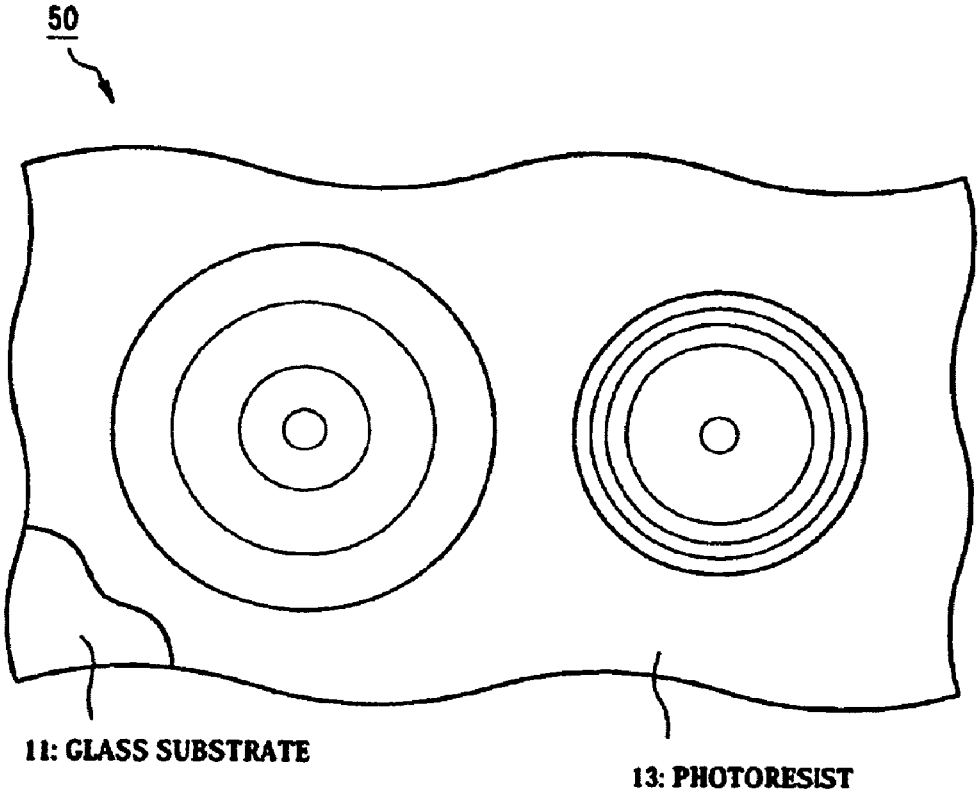
FIGS. 4A–B show an example of an exposure pattern in scanning exposure according to a first embodiment.

FIG. 4(A) is a schematic diagram showing an example of an exposure pattern of the laser 14. The circles shown in FIG. 4(A) are contour lines showing light intensity distributions when the laser 14 is condensed on the photoresist 13. The intensity of light is the highest in the center of the contour lines. In FIG. 4(A), the left pattern is the exposure pattern for forming the micro lens 52*a*, and the right pattern is the exposure pattern for forming the micro lens 52*b*.

Figure 4B:
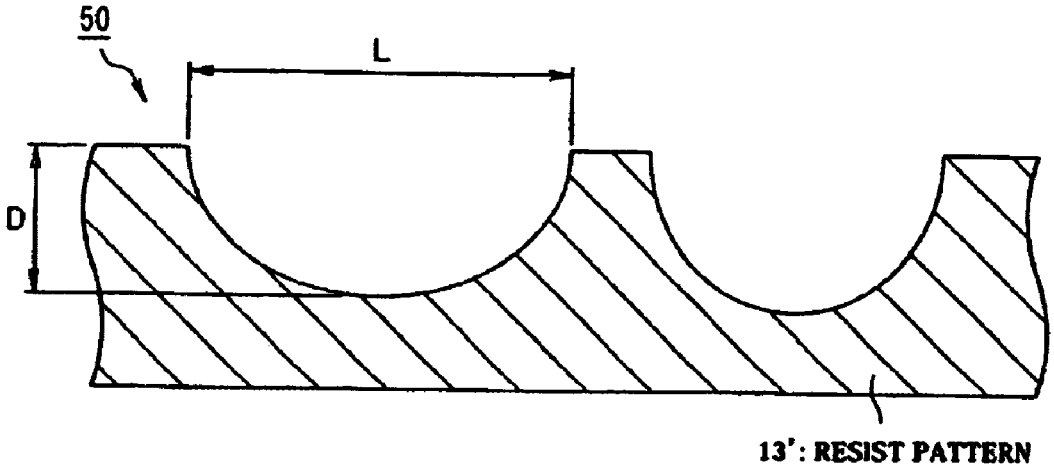

FIG. 4(B) is a schematic diagram showing an example of the resist pattern 13'. In FIG. 4(B), the concavity on the left is for forming the micro lens 52*a*, and the concavity on the right is for forming the micro lens 52*b*. As is clear from FIGS. 4(A) and 4(B), the more contour lines of light intensity that are present (i.e., the higher the intensity the light is), the more deeply the concavities of the resist pattern 13' are formed. In addition, the closer the contour lines of light intensity are together (i.e., the steeper the intensity distribution of light is), the more steeply the concavities of the resist pattern 13' are formed.

On the left in FIG. 4(B), the diameter L of the concavity of the resist pattern 13' is about 0.15 $\mu$m, and the depth D of the concavity is about 0.10 $\mu$m.

Figure 3C:
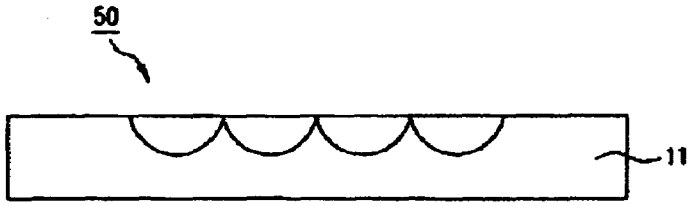

Next, as shown in FIG. 3(C), the glass substrate 11 is etched through the resist pattern 13'. This etching is a reactive ion etching using trifluoromethane ($CHF_3$). This etching removes the resist pattern 13' from the glass substrate 11. In addition, the glass substrate 11 is etched into a shape corresponding to the shape of the resist pattern 13'. In this way, the shape of the micro lens array 50 is transferred onto the glass substrate 11.

Figure 3D:
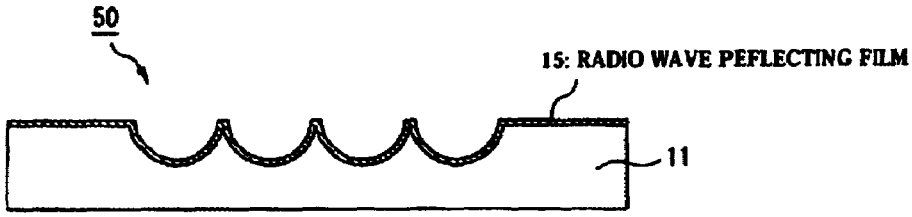

Then, as shown in FIG. 3(D), a radio wave reflecting film 15 is formed on the glass substrate 11 onto which the shape of the micro lens array 50 is transferred. The radio wave reflecting film 15 is formed of, for example, aluminum or silver and formed by, for example, a sputtering process. In this way, the micro lens array 50 shown in FIG. 1 is completed. Then, a receiver 70 (see FIG. 1) is fitted to the micro lens array 50. The antenna device 100 shown in FIG. 1 is thus completed.

As described above, unlike the conventional art, the antenna device 100 according to the first embodiment of the present invention can reflect radio waves 80*a* to 80*d* having different frequencies with a single micro lens array 50 and can receive the reflected radio waves 80*a* to 80*d* with a single receiver 70. Therefore, the antenna device 100 can receive radio waves in a broad frequency band and its number of parts is small. Since its number of parts is small, it can be manufactured at low cost.

A front-end process of manufacturing a semiconductor device can be applied to manufacturing the micro lens array 50. Therefore, four types of micro lenses 52*a* to 52*d* can be formed on one glass substrate 11 with high accuracy. The diameters, depths, and shapes of the micro lenses 52*a* to 52*d* are different from each other according to the radio waves 80*a* to 80*d* with particular frequencies.

Adjusting an exposure pattern in scanning exposure makes it possible and easy to change the shape of the micro lens array 50. This makes it possible and easy to manufacture the antenna device 100 corresponding to the frequencies of radio waves to be received.

In the first embodiment, the micro lens array 50 corresponds to a reflector of the present invention. The glass substrate 11 corresponds to a predetermined substrate of the present invention. The resist pattern 13' corresponds to a mask pattern of the present invention. The concavities of the resist pattern 13' correspond to a particular shape of the present invention. The radio wave reflecting film 15 corresponds to a reflecting film of the present invention. The radio waves 80*a* to 80*d* correspond to radio waves with particular frequency ranges of the present invention. The micro lenses 52*a* to 52*d* correspond to lenses of the present invention.

Figure 5:
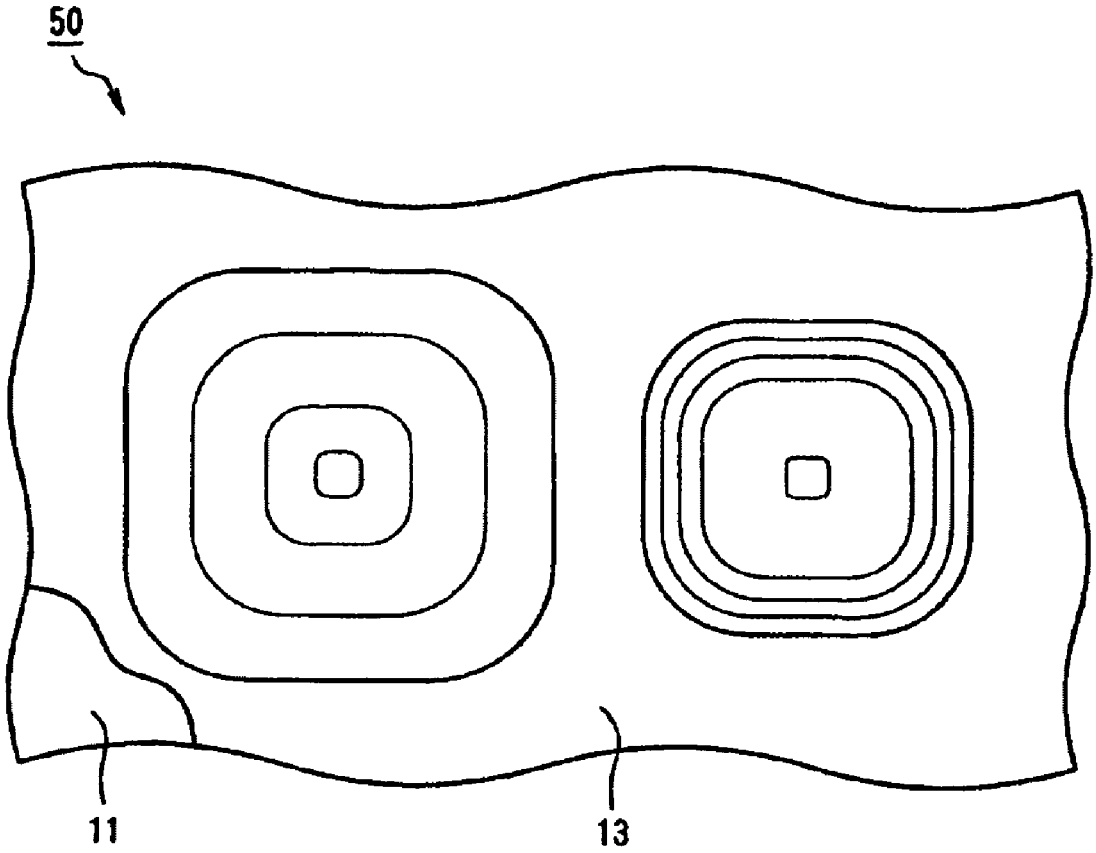
FIG. 5 shows another example of an exposure pattern in scanning exposure.

Incidentally, although circular patterns are illustrated in FIG. 4(A) as an example of exposure patterns of the laser 14, exposure patterns of the laser 14 are not limited to circles. For example, exposure patterns of the laser 14 may be substantially square as shown in FIG. 5. In this case, when viewed from above, substantially square recesses are formed on the photoresist 13 (see FIG. 3).

Second Embodiment

The method described in the above first embodiment is such that, when the micro lens array 50 is formed, pattern shapes of the resist pattern 13' are transferred onto the glass substrate 11 by dry-etching the resist pattern 13' and the glass substrate 11. However, methods of forming the micro lens array 50 are not limited to this.

FIGS. 6(A) to 7(C) show processes of forming micro lens array 50 according to the second embodiment of the present invention. In the second embodiment, a method of manufacturing a reflective micro lens array 50 by using a process of manufacturing a stamper will be described. Therefore, in FIGS. 6(A) to 7(C), the same reference numerals will be used to designate the same components as those in the first embodiment, so that the description thereof can be omitted.

Figure 6A:
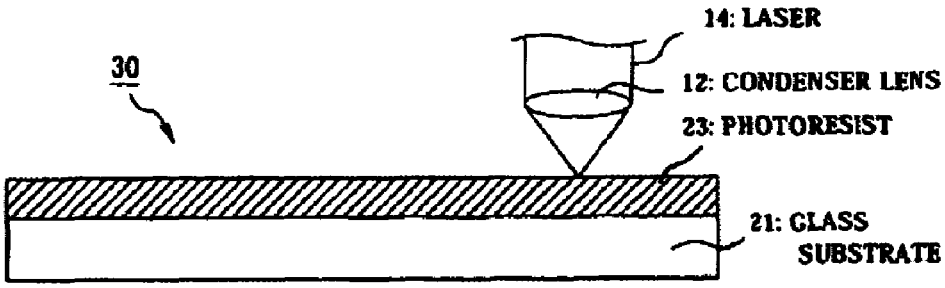
FIGS. 6A–D show a method of manufacturing the micro lens array 50 according to a second embodiment.
Figure 6B:
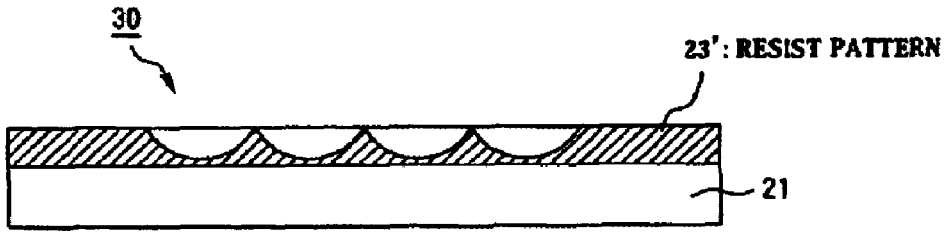

As shown in FIG. 6(A), a glass substrate 21 is first prepared. The surface (reflecting surface) of the glass substrate 21 is planarized. The glass substrate 21 has a radius of about 100 mm.

Next, the surface of the glass substrate 21 is treated with hexamethyldisilazane (HMDS) vapor. After this process, a layer of positive photoresist 23 is applied on the glass substrate 21. The thickness of the layer of photoresist 23 is about 10 $\mu$m. A laser 14 such as a krypton fluoride excimer laser (248 nm) or an argon fluoride excimer laser (193 nm) is condensed on the photoresist 23 by a condenser lens 12. The laser 14 scans and exposes the photoresist 23. Development of the exposed photoresist 23 reveals a resist pattern 23' corresponding to the shapes (concavities) of the micro lenses 52*a* to 52*d*.

Figure 6C:
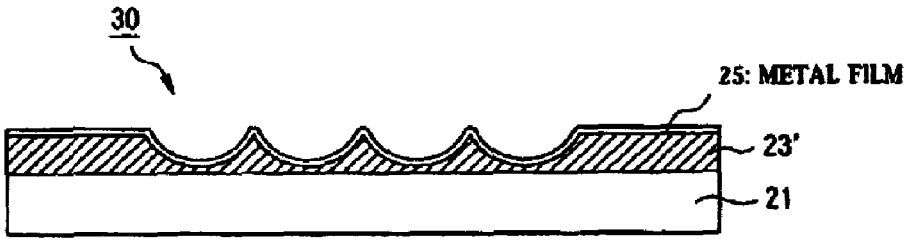

Next, as shown in FIG. 6(C), a metal film 25 of, for example, a silver-silicon alloy is formed on the resist pattern 23'. The metal film 25 is not limited to a silver-silicon alloy. The metal film 25 may be formed of any metal material that dissolves in a solvent such as acetone, methyl ethyl ketone, or ethanol. The metal film 25 is formed, for example, by a sputtering process.

Next, the metal film 25 on the resist pattern 23' is etched with a solvent such as acetone, methyl ethyl ketone, or ethanol. The concavities of the resist pattern 23' have diameters of about 0.15 $\mu$m and depths of about 0.10 $\mu$m. Since the concavities are small, the concavities do not sufficiently come into contact with the solvent in comparison with the flat portion. Therefore, the metal film 25 in the concavities is not removed and remains.

Figure 6D:
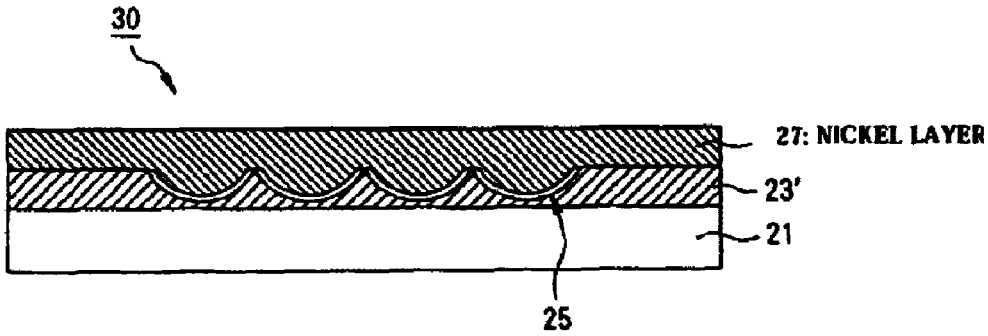
Figure 7A:
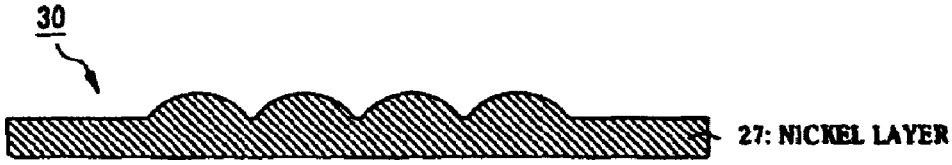
FIGS. 7A–C show a method of manufacturing the micro lens array 50 according to a second embodiment.

Next, a first nickel (Ni) layer is formed on the resist pattern 23' by a sputtering process. In addition, a second nickel layer is formed by electroforming (electroplating) on the first nickel layer as an electrode. In this way, as shown in FIG. 6(D), a nickel layer 27 is formed on the resist pattern 23' and the metal film 25. Next, this nickel layer 27 is separated from the resist pattern 23' and the metal film 25. As shown in FIG. 7(A), a stamper 30 for forming the micro lens array is thus completed.

Figure 7B:
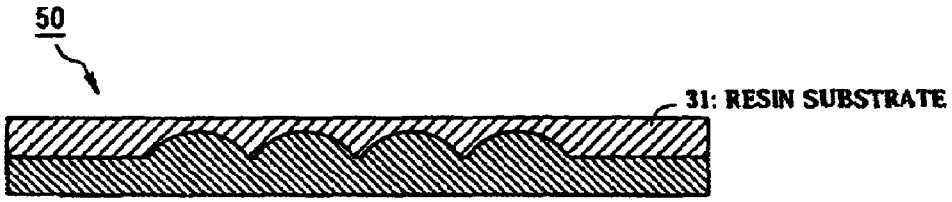
Figure 8:
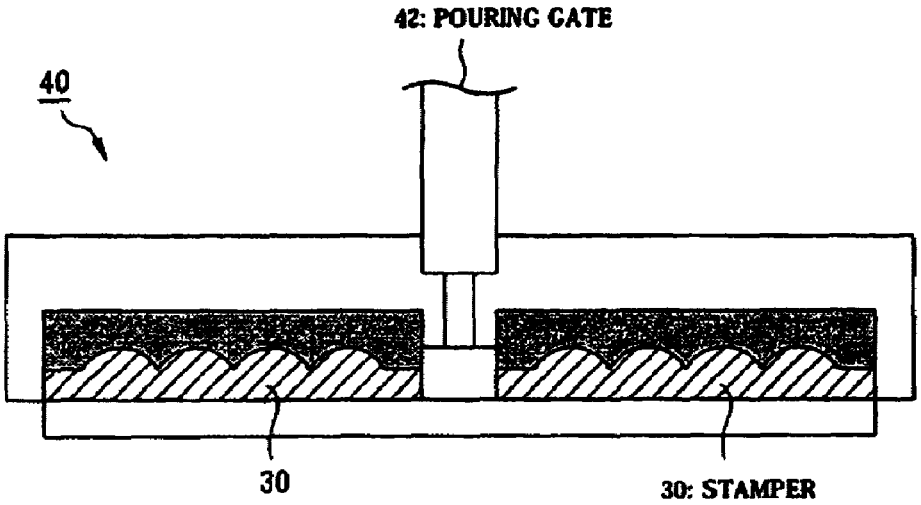
FIG. 8 is a schematic diagram showing an exemplary structure of an injection molding machine 40.

The stamper 30 is placed in an injection molding machine 40 as shown in FIG. 8. Molten resin such as polycarbonate resin and acrylic resin is injected at high pressure into a pouring gate 42 of the injection molding machine 40 and then cooled. In this way, a resin substrate 31 is formed as shown in FIG. 7(B). On the surface of the resin substrate 31, concavities which correspond to convexities of the stamper 30 are formed.

Figure 7C:
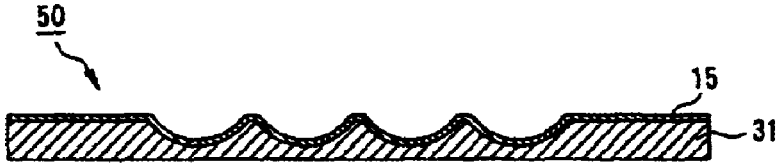

Then, as shown in FIG. 7(C), aluminum or silver, for example, is deposited on the surface having concavities of the resin substrate 31 by, for example, sputtering. A radio wave reflecting film 15 is thus formed. In this way, a micro lens array 50 is completed.

In the second embodiment, the stamper 30 for forming the micro lens array is completed in advance. Then the stamper 30 is placed in an injection molding machine 40 and reused.

Once the stamper 30 is formed, the micro lens array 50 can be completed by repeating the processes shown in FIGS. 7(B) to 7(C). Therefore, the number of steps for forming the micro lens array 50 is smaller than that in the first embodiment, and forming the micro lens array 50 is much easier than that in the first embodiment. In the second embodiment, the resin substrate 31 corresponds to a predetermined substrate of the present invention.

What is claimed is:

1. An antenna device comprising:

a reflector;

a receiver receiving reflected radio waves from one side of the reflector, wherein the one side of the reflector includes a plurality of lenses, the plurality of lenses including at least a first lens with a first radio wave reflective characteristic and a second lens with a second radio wave reflective characteristic, the first and second radio wave reflective characteristics being different to selectively reflect radio waves with particular frequency ranges to the receiver;

a third lens having a third radio wave reflective characteristic which is different from the first and second radio wave reflective characteristics to selectively reflect radio waves with particular frequency ranges to the receiver;

a fourth lens having a fourth radio wave reflective characteristic which is different from the first, second and third radio wave reflective characteristics to selectively reflect radio waves with particular frequency ranges to the receiver; and an array of each of said first, second, third, and fourth lenses on the one side of the reflector.

2. The antenna device of claim 1 wherein the first, second, third, and fourth radio wave reflective characteristics are defined according to at least one of the diameter, depth, and cross-sectional profile of the first, second, third, and fourth lenses.

* * * * *